US007752040B2

(12) United States Patent
Malvar et al.

(10) Patent No.: US 7,752,040 B2
(45) Date of Patent: Jul. 6, 2010

(54) STATIONARY-TONES INTERFERENCE CANCELLATION

(75) Inventors: Henrique S. Malvar, Redmond, WA (US); Ivan Tashev, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 769 days.

(21) Appl. No.: 11/692,911

(22) Filed: Mar. 28, 2007

(65) Prior Publication Data

US 2008/0243497 A1 Oct. 2, 2008

(51) Int. Cl.
*G10L 19/00* (2006.01)

(52) U.S. Cl. ..... 704/227

(58) Field of Classification Search ..... 704/227
See application file for complete search history.

(56) References Cited

U.S. PATENT DOCUMENTS

| | | | | |
|---|---|---|---|---|
| 4,025,721 | A | 5/1977 | Graupe | |
| 5,208,837 | A | 5/1993 | Richey | |
| 5,222,148 | A | 6/1993 | Yuan | |
| 5,402,496 | A | 3/1995 | Soli et al. | |
| 5,627,746 | A | 5/1997 | Ziegler, Jr. et al. | |
| 5,875,216 | A | 2/1999 | Martin | |
| 6,137,888 | A | 10/2000 | McClennon et al. | |
| 6,785,648 | B2 * | 8/2004 | Menendez-Pidal et al. | 704/233 |
| 7,050,954 | B2 | 5/2006 | Singh et al. | |
| 7,533,017 | B2 * | 5/2009 | Gotanda et al. | 704/226 |
| 7,565,288 | B2 * | 7/2009 | Acero et al. | 704/226 |
| 2006/0136203 | A1 | 6/2006 | Ichikawa | |

OTHER PUBLICATIONS

Andia, B., Restoration of speech signals contaminated by stationary tones using an image perspective, Proc. of IEEE ICASSP, May 2006, Toulouse, France.

Andrieu, C., M. Davy, A. Doucet, Efficient particle filtering for jump markov systems, IEEE Trans. of Signal Processing, Jul. 2003, vol. 51, No. 7.

Boll, S., Suppression of acoustic noise in speech using spectral subtraction, IEEE Transactions on Acoustics, Speech, and Signal Processing, Apr. 1979, pp. 113-120, vol. 27, No. 2.

Dahl, M., I. Claesson, Acoustic noise and echo cancelling with microphone array, IEEE Transactions on Vehicular Tech., Sep. 1999, pp. 1518-1526, vol. 48, No. 5.

Davy, M., B. Leprette, C. Doncarli, N. Martin, Tracking of spectral lines in ARCAP time-frequency representation, Proc. of EUSIPCO, Rhodes Island, Greece, 1998.

(Continued)

*Primary Examiner*—Susan McFadden
(74) *Attorney, Agent, or Firm*—Lyon & Harr, LLP; Mark A. Watson

(57) ABSTRACT

An "Interference Canceller" provides a computationally efficient real-time technique for removing stationary-tone interference from signals. Typical sources of stationary tone contamination of signals include noise from power wiring (i.e., 50/60 Hz or 400 Hz and their harmonics), frame or line frequencies from electronic devices, and noise from computer fans, hard disk drives, etc. In general, the Interference Canceller adaptively builds and updates a model of stationary tone interference in consecutive frames of an input signal. This adaptively updated model is then used to extrapolate and subtract noise from subsequent frames of the input signal to generate a "clean" output signal. This output signal exhibits significant attenuation of stationary tone interference without eliminating important portions of the underlying signal or distorting the underlying signal with artifacts such as musical noise or nonlinear distortions. The Interference Canceller is applicable for use either alone, or as pre-processor to conventional noise suppression.

20 Claims, 3 Drawing Sheets

OTHER PUBLICATIONS

Ephraim, Y., and D. Malah, Speech enhancement using a minimum mean-square error log-spectral amplitude estimator, IEEE Trans. on Acoustics, Speech, and Signal Processing, Apr. 1985, vol. 33, No. 2, pp. 443-445.

Kim, H., K. Oobermayer, M. Bode, and D. Ruwisch, Efficient speech enhancement by diffusive gain factors (DGF), Proc. Eurospeech, 2001, pp. 1867-1870.

Malvar, H. S., A modulated complex lapped transform and its applications to audio processing, Proc. of IEEE ICASSP, Phoenix, Mar. 1999.

Roguet, W., N. Martin, A. Chehikian, Tracking of frequency in a time-frequency representation, Proc. of IEEE Int. Symp. on TFTS, 1996, pp. 341-344.

Sohn, J., N. S. Kim, and W. Sung, A statistical model-based voice activity detection, Signal Proc. Letters, Jan. 1999, vol. 6, pp. 1-3.

* cited by examiner

STATIONARY-TONES INTERFERENCE CANCELLATION

BACKGROUND

1. Technical Field

The invention is related to noise removal from signals, and in particular, to a technique that adaptively evaluates signals contaminated by approximately stationary noise sources, such as electrical line noise, noise from fans, etc., and develops an adaptive model that allows those noise sources to be directly cancelled from the underlying signal rather than filtered from the underlying signal.

2. Related Art

Noise contamination of signals is a very common problem. For example, one category of noise that frequently contaminates speech recordings (or other sensor-derived signals) includes the well known problem of "stationary tone" interference. In general, stationary tones are noise signals that contaminate an underlying signal at one or more particular frequencies or frequency bands. In other words, a time-frequency representation of an approximately stationary contaminating noise signal is generally represented as an approximately horizontal line having an approximately constant amplitude on a time-frequency domain plot of the contaminated signal. Another way to consider stationary interference of a signal is that the spectral changes of the "stationary" interference over time are much slower than those of the underlying signal that is contaminated by the stationary interference.

Stationary tone noise generally originates from a variety of sources such as direct line noise sources or via acoustic or inductive coupling. Various examples of these types of noise sources include power wiring, inadequate shielding or grounding of microphone or sensor cables, placement of the microphones or sensors near power lines or transformers, etc. Stationary tone noise sources also include noise resulting from positioning microphones or other sensors near TVs, monitors, video cameras, etc., where the microphones can capture interference at frame or line frequencies, either acoustically from transformers or electronically from the cables. Other stationary tone noise sources include relatively constant frequency noise such as background noises coming from the acoustical environment, such as fans, computer hard drives, air conditioning, etc.

A simple example of the effects of stationary tone interference in an audio recording of speech is an audible hum resulting from electrical power line noise. These types of noise are sometimes quite loud relative to the underlying speech signal. Such noise generally occurs at the frequency of the power source (i.e., 50/60 Hz or 400 Hz) and also often occurs at one or more harmonics of those frequencies. Unfortunately, such noise often at least partially overlaps some of the speech frequencies in the audio recording.

Conventional techniques for removing stationary tone noise contamination from signals generally focus on the use of a stationary noise suppressor to filter specific frequency ranges from the signal. Various conventional filter types, such as, for example, notch filters, comb filters, low-pass filters, high-pass filters, band-pass filters, etc., are used to eliminate or pass particular frequency bands of the signal in an attempt to eliminate or attenuate the stationary tone noise in the signal.

The use of conventional filters to remove stationary tone noise from the signal is generally successful in that the noise is eliminated. Unfortunately, where the frequency footprint of the contaminating noise at least partially overlaps the wanted content in the signal, the use of conventional filters to remove that contaminating noise will also remove wanted content from the signal. Further, such filtering often introduces unwanted artifacts, such as, for example, nonlinear distortions, "musical" noises, etc., into the filtered signal, resulting in a substantially distorted signal.

Other, more complex, approaches to noise suppression have been developed to suppress stationary tone interference or noise in signals while creating less distortion to the underlying wanted signal content. These more complicated approaches typically operate by closely tracking frequencies of noise in a time-frequency representation of the signal to identify the spectral lines of noise in the signal for use in removing noise content from the signal. Unfortunately, these noise suppression techniques are generally computationally expensive and not typically appropriate for real-time noise cancellation. In fact, many such techniques are used to process audio signals offline rather than in real-time.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An "Interference Canceller," as described herein, provides a computationally efficient real-time technique removing stationary-tone interference from signals. In general, the Interference Canceller operates in the frequency domain to adaptively build and update a model of stationary tone interference in consecutive frames of an input signal. This adaptively updated model is then used to extrapolate and subtract noise from subsequent frames of the input signal based on an estimation of a complex plane rotation "speed" (also referred to as a "phase shift speed") which represents an estimated speed of rotation of frequency components of the interference model of the present frame towards the next frame. The result of this rotation speed based complex plane subtraction is that the Interference Canceller generates a "clean" output signal exhibiting a significant attenuation of the stationary tone interference without distorting the underlying signal with artifacts such as musical noise or nonlinear distortions.

As noted above, the Interference Canceller operates to cancel stationary tones in the frequency domain. Consequently, in various embodiments, once the Interference Canceller has generated a cleaned version of the input signal in the frequency domain, that signal is then further processed to provide a desired output. For example, in one embodiment, the cleaned frequency domain signal is transformed back into a time domain signal for real-time playback or storage for later use.

In a related embodiment, the Interference Canceller takes advantage of the frequency-domain cleaned signal by performing further frequency domain noise suppression to address other signal noise that is predictable. Since many such noise suppression techniques operate in the frequency domain, it is simple to provide the frequency domain cleaned signal to conventional frequency-domain noise suppression algorithms for further noise reduction. Then, given the output of this further level of noise suppression, the resulting frequency-domain signal is transformed back into a time domain signal for real-time playback or storage for later use. Clearly, in view of this example, once the Interference Canceller has produced the initial frequency domain cleaned signal, any further frequency-domain processing, conventional or otherwise, can be performed on that signal to produce the desired output.

In view of the above summary, it is clear that the Interference Canceller described herein provides a unique system and method for real-time cancellation of stationary tone interference from underlying signals without distorting the underlying signal. In addition to the just described benefits, other advantages of the Interference Canceller will become apparent from the detailed description that follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
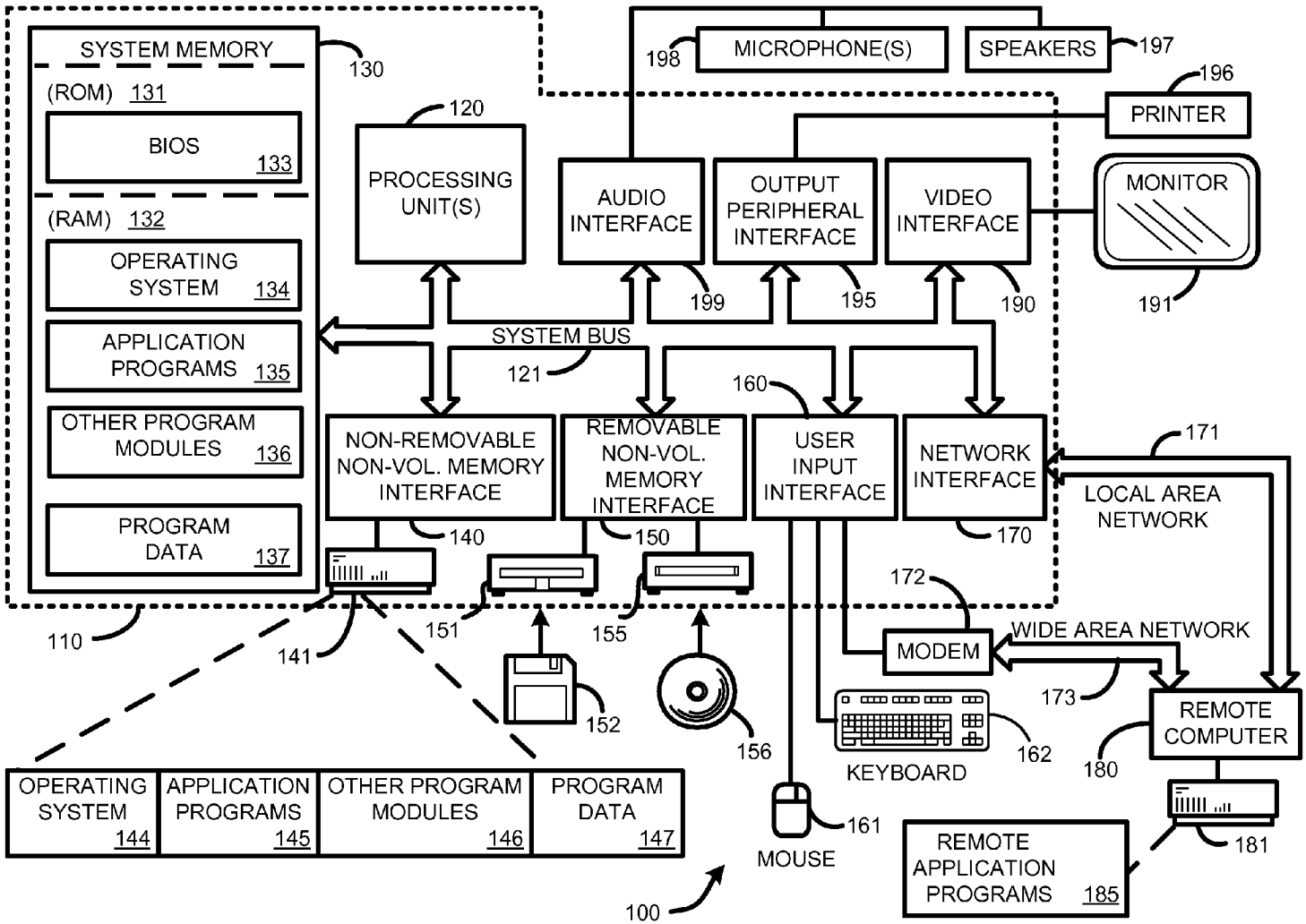
FIG. 1 is a general system diagram depicting a general-purpose computing device constituting an exemplary system for implementing an Interference Canceller, as described herein.
Figure 2:
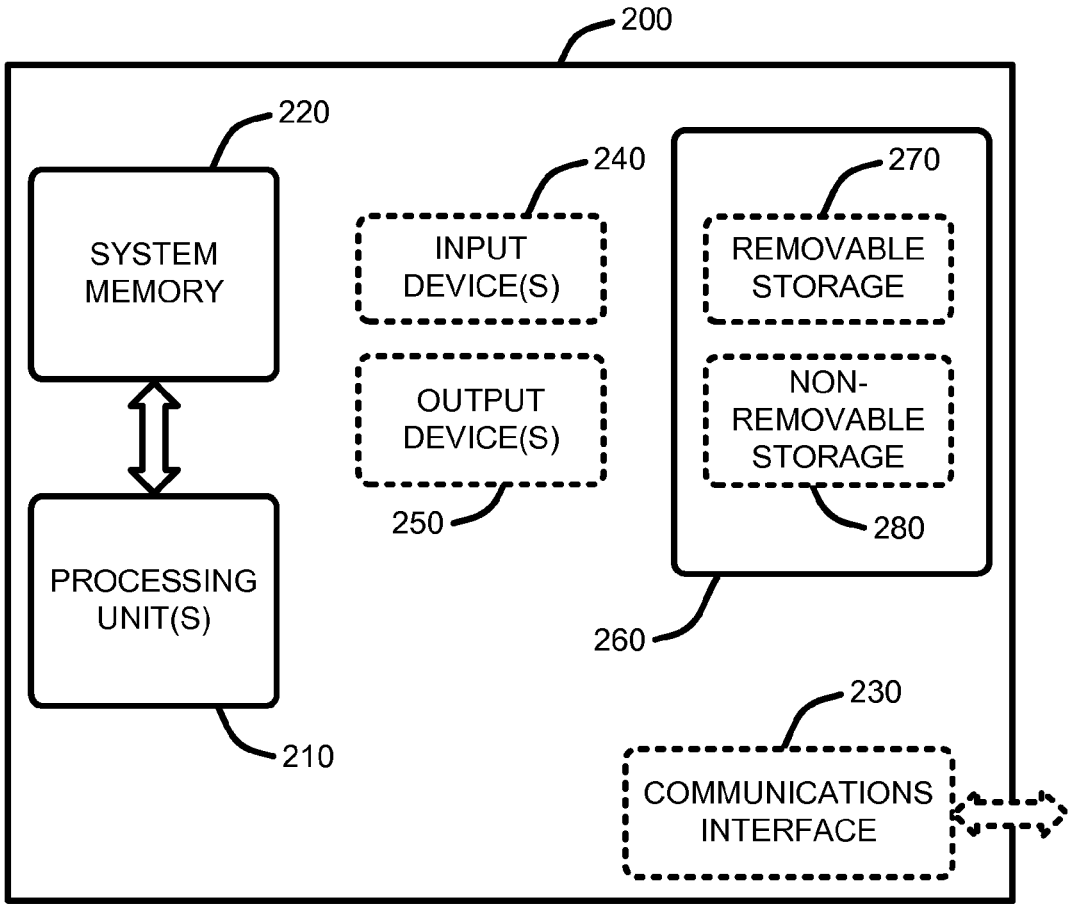
FIG. 2 is a general system diagram depicting a general device having simplified computing and I/O capabilities for use in implementing the Interference Canceller, as described herein.

1.0 Exemplary Operating Environment:

FIG. 1 and FIG. 2 illustrate two examples of suitable computing environments on which various embodiments and elements of an Interference Canceller, as described herein, may be implemented. It should also be noted that in addition to the generic computing environments described below, the Interference Canceller may also be implemented within specialized hardware, such as, for example, a For example, FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer in combination with hardware modules, including components of a microphone array 198. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media such as volatile and nonvolatile removable and non-removable media implemented in any method or technology for storage of information such as computer readable instructions, data structures, program modules, or other data.

For example, computer storage media includes, but is not limited to, storage devices such as RAM, ROM, PROM, EPROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

Other input devices (not shown) may include a joystick, game pad, satellite dish, scanner, radio receiver, and a television or broadcast video receiver, or the like. These and other input devices are often connected to the processing unit 120 through a wired or wireless user input interface 160 that is coupled to the system bus 121, but may be connected by other conventional interface and bus structures, such as, for example, a parallel port, a game port, a universal serial bus (USB), an IEEE 1394 interface, a Bluetooth™ wireless interface, an IEEE 802.11 wireless interface, etc. Further, the computer 110 may also include a speech or audio input device, such as a microphone or a microphone array 198, as well as a loudspeaker 197 or other sound output device connected via an audio interface 199, again including conventional wired or wireless interfaces, such as, for example, parallel, serial, USB, IEEE 1394, Bluetooth™, etc.

A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

With respect to FIG. 2, this figure provides a general system diagram that illustrates a simplified computing device. Such computing devices can be typically be found in devices having at least some minimum computational capability in combination with a communications interface, including, for example, cell phones PDA's, dedicated media players (audio and/or video), etc. It should be noted that any boxes that are represented by broken or dashed lines in FIG. 2 represent alternate embodiments of the simplified computing device, and that any or all of these alternate embodiments, as described below, may be used in combination with other alternate embodiments that are described throughout this document.

At a minimum, to allow a device to implement the Interference Canceller, the device must have some minimum computational capability, and some memory or storage capability. In particular, as illustrated by FIG. 2, the computational capability is generally illustrated by processing unit(s) 210 (roughly analogous to processing units 120 described above with respect to FIG. 1). Note that in contrast to the processing unit(s) 120 of the general computing device of FIG. 1, the processing unit(s) 210 illustrated in FIG. 2 may be specialized (and inexpensive) microprocessors, such as a DSP, a VLIW, or other micro-controller rather than the general-purpose processor unit of a PC-type computer or the like, as described above.

In addition, the simplified computing device of FIG. 2 may also include other components, such as, for example one or more input devices 240 (analogous to the input devices described with respect to FIG. 1). The simplified computing device of FIG. 2 may also include other optional components, such as, for example one or more output devices 250 (analogous to the output devices described with respect to FIG. 1). Finally, the simplified computing device of FIG. 2 also includes storage 260 that is either removable 270 and/or non-removable 280 (analogous to the storage devices described above with respect to FIG. 1).

Finally, it should be noted that since many modern processors include both processing capability and memory as well as I/O capabilities on a single "computer chip" or the like, the entire process enabled by the Interference Canceller, as described in detail below, can be implemented within the hardware of a single specialized processor unit for use within other hardware devices such as, for example, telephones, cell phones, media players, data recording or processing devices, etc.

The exemplary operating environment having now been discussed, the remaining part of this description will be devoted to a discussion of the program modules and processes embodying an "Interference Canceller" which provides a unique system and method for real-time cancellation of stationary tone interference from underlying signals.

2.0 Introduction:

An "Interference Canceller," as described herein, a computationally efficient real-time technique for removing stationary tone interference from signals. In general, the Interference Canceller adaptively builds and updates a model of stationary tone interference in consecutive frames of an input signal. This adaptively updated model is then used to extrapolate and subtract noise from subsequent frames of the input signal to generate a "clean" output signal. This output signal exhibits significant attenuation of stationary tone interference without eliminating important portions of the underlying signal or distorting the underlying signal with artifacts such as musical noise or nonlinear distortions. Further, the Interference Canceller is applicable for use either alone, or as preprocessor to conventional noise suppression or other frequency- or time-domain processing, as desired.

In general, as understood by those skilled in the art, stationary tones are noise signals that contaminate an underlying signal at one or more particular frequencies or frequency bands. However, the frequencies of this noise are not generally perfectly fixed. As such, the use of the term "stationary tone," and similar terms, is intended to encompass noise contamination of signals that is approximately stationary in nature, with some amount of frequency and/or amplitude drift over time. Typical sources of stationary tone contamination of signals include noise from power wiring (i.e., 50/60 Hz or 400 Hz and their harmonics), frame or line frequencies from electronic devices, noise from computer fans and hard disk drives, etc.

Further, it should also be noted that the Interference Canceller is fully capable of cancelling stationary tones or noise (also referred to as "constant tones") in various types of signals of various dimensionalities, such as, for example, video signals, audio signals, electrocardiogram (EKG) signals, accelerometer signals, thermocouple data, sensor data, etc. However, for purposes of explanation, the following discussion will generally describe cancellation of stationary tone interference in audio signals. Extrapolation of the various embodiments of the Interference Canceller, as described throughout this document, for use with other signal types of various dimensionalities should be obvious to those skilled in the art in view of the following discussion.

2.1 System Overview:

In general, the Interference Canceller operates in the frequency domain to adaptively build and update a model of stationary tone interference in consecutive frames of an input signal. This adaptively updated model is then used to extrapolate and subtract noise from subsequent frames of the input signal based on an estimation of a complex plane rotation "speed" (also referred to as a "phase shift speed") which represents an estimated speed of rotation of frequency components of the interference model of the present frame towards the next frame. The result of this rotation speed based complex plane subtraction is that the Interference Canceller generates a "clean" output signal exhibiting a significant attenuation of the stationary tone interference without distorting the underlying signal with artifacts such as musical noise or nonlinear distortions.

Further, as noted above, the Interference Canceller operates to cancel stationary tones in the frequency domain. Consequently, in various embodiments, once the Interference Canceller has generated a cleaned version of the input signal in the frequency domain, that signal is then further processed to provide a desired output. For example, in one embodiment, the cleaned frequency domain signal is transformed back into a time domain signal for real-time playback or storage for later use.

In a related embodiment, the Interference Canceller takes advantage of the frequency-domain cleaned signal by performing further frequency domain noise suppression to address other signal noise that is predictable. Since many such noise suppression techniques operate in the frequency domain, it is simple to provide the frequency domain cleaned signal to conventional frequency-domain noise suppression algorithms for further noise reduction. Then, given the output of this further level of noise suppression, the resulting frequency-domain signal is transformed back into a time domain signal for real-time playback or storage for later use. Clearly, in view of this example, once the Interference Canceller has produced the initial frequency domain cleaned signal, any further frequency-domain processing, conventional or otherwise, can be performed on that signal to produce the desired output.

Figure 3:
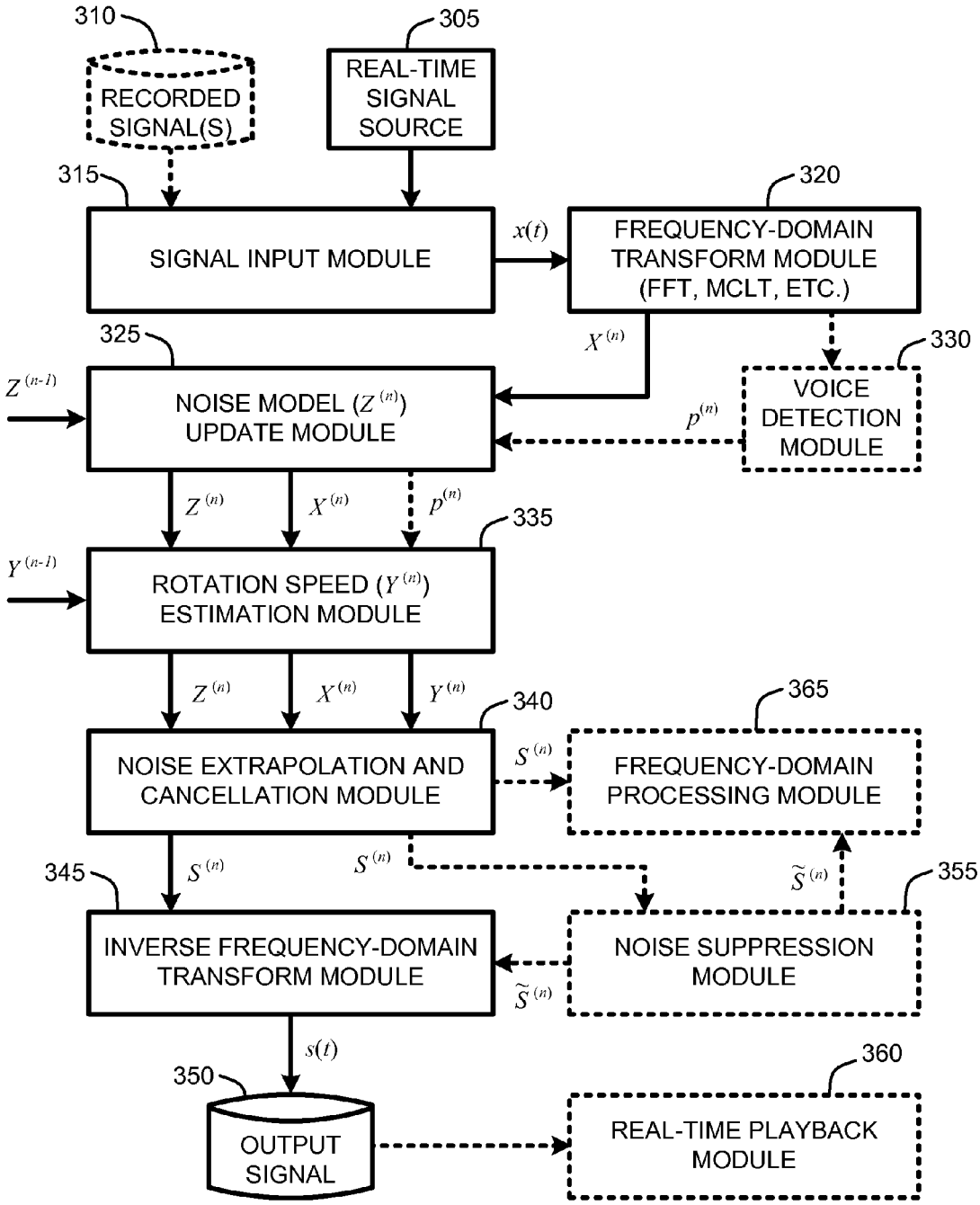
FIG. 3 provides an exemplary architectural flow diagram that illustrates program modules for implementing the Interference Canceller, as described herein.

2.2 System Architectural Overview:

The processes summarized above are illustrated by the general system diagram of FIG. 3. In particular, the system diagram of FIG. 3 illustrates the interrelationships between program modules for implementing the Interference Canceller, as described herein. It should be noted that any boxes and interconnections between boxes that are represented by broken or dashed lines in FIG. 3 represent alternate embodiments of the Interference Canceller described herein, and that any or all of these alternate embodiments, as described below, may be used in combination with other alternate embodiments that are described throughout this document.

Further, it should be noted that while FIG. 3 illustrates the stationary tone noise cancellation in an audio signal, the Interference Canceller is fully capable of cancelling stationary tone noise in various types of signals of various dimensionality. However, for purposes of explanation, the following discussion will describe cancellation of stationary tone interference in audio signals. Extrapolation of the various embodiments of the Interference Canceller, as described throughout this document, for use with other signal types should be obvious to those skilled in the art in view of the following discussion.

In general, as illustrated by FIG. 3, the Interference Canceller begins operation by using a signal input module 315 to receive a contaminated (noisy) input signal, x(t), from either a real-time signal source 305 or from a stored signal 310. The signal input module 315 then provides consecutive overlapping frames of time-domain samples of the input signal, x(t), to a frequency-domain transform module 320 that transforms each overlapping frame of the time-domain audio signal into corresponding blocks of frequency-domain transform coefficients, $X^{(n)}$. Note that as discussed in further detail in Section 3.2, the frequency-domain transform module 320 can be implemented using any of a number of conventional transform techniques, including, for example, FFT-based techniques, modulated complex lapped transform (MCLT) based techniques, etc.

Next, once each frame of the input signal has been converted from the time-domain to the frequency-domain by the frequency-domain transform module 320, the corresponding blocks of frequency-domain transform coefficients are provided to a noise model update module 325 that computes an estimate, $Z^{(n)}$, of stationary noise in the input signal as a function of the state of the estimated noise, $Z^{(n-1)}$, for the prior frame. Note that for the first frame, the noise model estimate, $Z^{(n)}$, is initialized as the computed estimate without considering the prior frame.

In addition, in one embodiment, prior to estimating the noise model for each frame, a probability of signal presence, $p^{(n)}$, is computed to determine a probability of whether the current frame includes only contaminating noise, or some wanted signal component (see Section 3.4.2 for further details). For example, in a tested embodiment applied to a speech signal having periodic speech, such as a telephone call, for example, a conventional voice activity detector (VAD) was implemented in a voice detection module 325 to compute this probability. Note that different signal detectors may be used, depending upon the signal type.

In either case, whether or not a signal presence probability is computed, the Interference Canceller continues operation by using a rotation speed estimation module 335 to estimate a rotation speed, $Y^{(n)}$, of frequency components of the estimated noise model, $Z^{(n)}$. As discussed in further detail in Sections 3.3 and 3.4, this rotation speed is used in combination with the estimated noise model to cancel stationary noise from the input signal. It should also be noted that the order of operation of the processes performed by the noise model update module 325 and the rotation speed estimation module 335 can be switched, if desired.

In particular, given the estimated noise model and the estimated rotation speed of the frequency components of that noise model, the Interference Canceller uses a noise cancellation module 340 to perform a frequency-domain subtraction of the estimated noise from the input signal to recover a frequency-domain estimate, $S^{(n)}$, of an uncontaminated version s(t) of the contaminated input signal x(t).

Specifically, given the frequency-domain estimate, $S^{(n)}$, the Interference Canceller uses an inverse frequency domain transform module 345 to transform given the frequency-domain estimate, $S^{(n)}$, back into the time domain by applying the inverse of the transform applied by the frequency-domain transform module 320. As such, the output of the inverse frequency domain transform module 345 is an output signal 350 (s(t)) that represents a "cleaned" version of the contaminated input signal x(t). Then, in one embodiment, a real-time playback module 360 begins playback of the recovered output signal 350 as soon as the first frame of the output signal is generated by the inverse frequency domain transform module 345.

In another embodiment, prior to providing the frequency-domain estimate, $S^{(n)}$, to the inverse frequency domain transform module 345, the Interference Canceller first uses a noise suppression module 355 to process the frequency domain coefficients of $S^{(n)}$ to remove or attenuate any non-predictable noise contamination in the input signal. Following processing by the noise suppression module 355, the inverse frequency domain transform module 345 performs the functions described above, but this time, it operates on the version of the cleaned signal processed by the noise suppression module 355.

In a related embodiment, the Interference Canceller uses a frequency-domain processing module 365 to perform any other desired conventional frequency domain operations on the cleaned frequency-domain estimate, $S^{(n)}$, of the input signal. As is known to those skilled in the art, there are a very large number of frequency domain operations that can be performed on the transform coefficients of a signal, such as, for example, encoding or transcoding the input signal, scaling the input signal, watermarking the input signal, identifying the input signal using conventional signal fingerprinting techniques, etc.

3.0 Operation Overview:

The above-described program modules are employed for implementing the Interference Canceller. As summarized above, the Interference Canceller provides frequency domain cancellation of stationary tone interference in consecutive frames of an input signal based on an adaptively updated noise model in combination with a model of complex plane noise frequency rotation speeds. The following sections provide a detailed discussion of the operation of the Interference Canceller, and of exemplary methods for implementing the program modules described in Section 2 with respect to FIG. 3.

3.1 Operational Details of the Interference Canceller:

The following paragraphs detail specific operational and alternate embodiments of the Interference Canceller described herein. In particular, the following paragraphs describe details of the Interference Canceller operation, including: Interference Canceller overview; signal types; modeling and extrapolation of contaminating signals; noise cancellation; and model updates.

3.2 Interference Canceller Overview:

In general, the Interference Canceller operates by first transforming overlapping frames of a time domain signal to corresponding blocks of transform-domain coefficients using conventional transform techniques. It should be noted that the actual frequency domain transform (FFT, DCLT, MCLT, etc.) used by the Interference Canceller is not a critical decision, so long as the inverse of that transform can be applied to recover a time domain signal once the Interference Canceller has finished cancelling stationary tone interference from the frequency domain coefficients of the input signal as described in detail below. However, for real-time applications, some types of transforms, such as, for example, MCLT's, have been observed to provide good results for real-time noise cancellation. Further, the use of lossless transforms and inverse transforms is preferred in order to limit possible distortion of the input signal.

In general, once the Interference Canceller begins transforming frames of the input signal, the resulting transform coefficients are used to adaptively build and update a frequency-domain model of stationary tone interference in consecutive frames of the input signal. This adaptively updated model is then used to extrapolate and subtract noise from subsequent blocks of transform coefficients (representing subsequent frames of the input signal) based on an estimated speed of rotation of the frequency components of the interference model.

Note that the following discussion describes a real-time application for removing stationary tone interference from signals by processing each block of transform coefficients as soon as it is computed from the input signal. However, it should be clear that the same basic processes described below can also used to perform offline removal of stationary tone interference from input signals by transforming the entire input signal before beginning processing of the transform coefficients for removal of any stationary tone interference from that signal.

3.3 Signal Types and Noise Sources:

As noted above, the Interference canceller is capable of removing stationary tone interference or noise from signals of various types and dimensionalities. One common example of a signal contaminated by stationary noise includes an audio signal contaminated by a 60 hertz hum resulting from an attached or adjacent power source. Another common example of a signal contaminated by noise is a video signal exhibiting periodic luminance changes resulting from a stationary interference source contaminating the video feed.

Without providing an exhaustive list of examples or signal and contamination sources, it should be clear that the basic problem to be solved is that an input signal, such as, for example, a video signal, audio signal, microphone signal, electrocardiogram (EKG) signal, accelerometer signal, thermocouple signal, etc., is contaminated by one or more stationary tone interference sources. The following paragraphs will generally describe the solution to this problem in terms of removing stationary interference from an audio signal. However, as noted above, the Interference Canceller is fully capable of canceling stationary interference in various types of signals, and is not intended to be limited to operation with audio signals.

3.3 Modeling and Extrapolation:

In general, the Interference Canceller operates on the assumption that any contaminating signal is stationary or pseudo-stationary in nature. In other words, the noise modeling and cancellation performed by the Interference Canceller operates on the assumption that the spectral changes of the contaminating signal are much slower than those of the underlying signal being contaminated by the stationary noise. Such noise is predictable. As such, the Interference Canceller will not act to cancel non-predictable noise sources (i.e., noise that is neither stationary nor pseudo-stationary) in a signal, and more importantly, the Interference Canceller will not cancel valid components of the underlying signal, such as speech content in an audio signal.

As noted above, the Interference Canceller operates in the frequency domain on blocks of transform coefficients computed from overlapping frames of the input signal. As is known to those skilled in the art, most conventional signal processing is performed on frequency domain representations of signal. Consequently, the Interference Canceller provides an ideal preprocessor for conventional noise suppression techniques which act to remove other, non-predictable, noise contamination of signals. Further, since in many cases, stationary noise is one of the largest noise sources contaminating a signal, the use of the Interference Canceller without further processing by other noise suppression techniques has been observed to provide significant improvements in signal to noise (SNR) ratio of contaminated signals.

3.3.1 Modeling Stationary Contamination in Signals:

In modeling noise in the blocks of transform coefficients, the Interference Canceller processes each frequency bin of the transform coefficients separately, assuming they are statistically independent. However, since this assumption is not completely accurate with respect to approximately stationary noise, the Interference Canceller ensures that the nature of correlated neighbor bins of each block of transform coefficients is considered in modeling the contaminating noise.

In general, the contaminating signal, z(t), is assumed to be a linear combination of sinusoidal signals and noise, (N), as illustrated by Equation 1:

$$z(t) = \sum_{i=1}^{L} A_i \sin(2\pi f_i t) + \mathbb{N}(0, \lambda) \qquad \text{Equation 1}$$

where L is the number of stationary tones, each with frequency $f_i$. Converting this signal to frequency domain yields the following contaminating signal model for the n-th signal frame, where:

$$Z_k^{(n)} = \sum_{i=1}^{L} W_T(k) * A_i e^{-j2\pi nTf_i} + \mathbb{N}(0, \lambda_N) \qquad \text{Equation 2}$$

where $W_T$ is the Fourier image of the frame weighting function, T is the audio frame step, n is the frame number and k is the frequency bin.

Given this frequency-domain noise model, it is important to note the following points:

1. Due to "smearing" of the spectral lines because of the weighting, bins neighboring the central bin (for each contaminating frequency) will contain portions of the energy of the contaminating signal.
2. These neighboring bins will rotate in the complex plane (phase shift) from frame to frame with the same speed, which can be different than the rotation speed of the each bin's central frequency, $e^{-j2\pi nTf_s/K}$.

For each frame, these two points are addressed when extrapolating the contaminating signal model for the next frame, as discussed in further detail below.

3.3.2 Extrapolating the Contaminating Signal:

Assuming perfect estimation of the contaminating signal in the frequency domain, $\hat{Z}_k^{(n-1)}$, for frame (n−1), then the extrapolation for the n-th frame will be:

$$\hat{Z}_k^{(n)} = \hat{Z}_k^{(n-1)} \frac{\sum_{i=1}^{L} W_T(k) * A_i e^{-j2\pi(n+1)Tf_i}}{\sum_{i=1}^{L} W_T(k) * A_i e^{-j2\pi nTf_i}} \qquad \text{Equation 3}$$

The second term in Equation 3 is a complex number that represents the "speed" of rotation of the complex contamination model from frame to frame. As noted in Section 3.3.1, this "speed" can be different than the "speed" of the central frequency of the bin. Further, since $W_T(k)$ decays quickly with increasing k, it is assumed that one frequency from the contaminating signal dominates in each frequency bin. Therefore, it is assumed that:

$$\frac{\sum_{i=1}^{L} W_T(k) * A_i e^{-j2\pi(n+1)Tf_i}}{\sum_{i=1}^{L} W_T(k) * A_i e^{-j2\pi nTf_i}} \approx e^{-j2\pi nTf_I} + \mathbb{N}(0, \lambda_E) \qquad \text{Equation 4}$$

where $f_I$ is the dominant, but unknown, frequency, and $\mathbb{N}(0, \lambda_E)$ is an error term to account for any small errors (manifesting as noise) introduced by the Interference Canceller because of the estimates made by the Interference Canceller when canceling the stationary noise from the signal, as described in further detail below. In a tested embodiment, this error term, $\mathbb{N}(0, \lambda_E)$, was modeled as zero mean Gaussian noise, however, other distributions can be used to model the error term if desired. Since the dominant frequency is unknown, the extrapolation from the contaminating signal in the prior frame, $\hat{Z}_k^{(n-1)}$, to the contaminating signal in the current frame, $\hat{Z}_k^{(n-1)}$, can be presented as illustrated by Equation 5, where:

$$\hat{Z}_k^{(n)} = \hat{Z}_k^{(n-1)} \hat{Y}_k^{(n-1)} \qquad \text{Equation 5}$$

where, as noted above, $\hat{Z}_k^{(n-1)}$, is the contaminating signal estimation for frame (n−1), and $\hat{Y}_k^{(n-1)}$ is the rotating "speed" of the model towards the next frame. As noted above, this rotating speed represents an estimated speed of rotation of frequency components of the interference model of the present frame towards the next frame. Further, in view of the preceding discussion, both of these components, $\hat{Z}_k$ and $\hat{Y}_k$, have additive Gaussian noise with variances $\lambda_N$ and $\lambda_E$, respectively.

3.4 Noise Cancellation and Model Update:

As noted above, the contaminated signal being processed by the Interference Canceller is a combination of some wanted signal and some contaminating signal. Given the expression of the contaminating noise signal, z(t), illustrated in Equation 1, adding that noise to an underlying wanted signal, s(t), the resulting contaminated signal, x(t) is simply s(t)+z(t), or as illustrated by Equation 6, $$x(t) = s(t) + \sum_{i-1}^{L} A_i \sin(2\pi f_i t) + \mathbb{N}(0, \lambda) \quad \text{Equation 6}$$

Clearly, it is desired to recover the best estimate possible of s(t) from the contaminated signal, x(t). However, as s(t) is not known, the corresponding frequency-domain representation, $S_k^{(n)}$, of s(t) is also not known. Therefore, in view of Equation 2 (which defines the frequency domain representation of the contamination signal model, $Z_k^{(n)}$), the representation in frequency domain of the n-th frame of the contaminated signal, $X_k^{(n)}$, is provided by Equation 7, which simply adds $S_k^{(n)}$ to $Z_k^{(n)}$, where:

$$X_k^{(n)} = S_k^{(n)} + \sum_{i-1}^{L} W_T(k) * A_i e^{-j2\pi nTf_i} + \mathbb{N}(0, \lambda_N) \quad \text{Equation 7}$$

3.4.1 Contaminating Signal Cancellation:

In view of the preceding paragraphs, it should be clear that that the estimation of the wanted signal, $S_k^{(n)}$, is given by $\hat{S}_k^{(n)}$, where $\hat{S}_k^{(n)}$ is simply the result of subtracting underlying the contamination estimate from the contaminated signal as illustrated by Equation 8, where:

$$\hat{S}_k^{(n)} = X_k^{(n)} - \hat{Z}_k^{(n)} \quad \text{Equation 8}$$

In other words, Equation 8 illustrates subtracting the frequency domain representation of the contaminating signal, $\hat{Z}_k^{(n)}$, estimated as illustrated by Equation 5, from the frequency domain representation of the contaminated signal, $X_k^{(n)}$ to provide a frequency domain representation of the estimated cleaned version of the input signal, $\hat{S}_k^{(n)}$. Note that this subtraction is performed separately for each frequency bin of the frequency domain representation of the contaminated signal.

In addition, it should also be noted that the frequency domain signal estimation, $\hat{S}_k^{(n)}$, still contains any original non-predictable noise, $\mathbb{N}(0, \lambda_N)$, and that the cancellation process described above may add some small additional noise component, $\mathbb{N}(0, \lambda_E)$, due to the approximations in the model and estimation errors. Therefore, while the frequency domain signal estimation, $\hat{S}_k^{(n)}$, has significantly attenuated noise relative to the contaminated signal, in various embodiments, $\hat{S}_k^{(n)}$ is further processed using conventional noise suppression techniques to further improve the overall SNR of the cleaned signal.

3.4.2 Updating the Contaminating Signal Model:

The preceding discussion describes subtraction of the contaminating signal from the frequency-domain representation of a single frequency bin of a single frame of the input signal. However, as noted above, the contaminating signal model is updated for every frame as a function of the preceding frame. Therefore, in parallel with the contaminating signal cancellation described in Section 3.4.1, the Interference Canceller constantly updates the contaminating signal model for each new overlapping frame.

In particular, for each frequency bin, the contaminating signal model for each new overlapping frame consists of four elements: $\hat{Z}(k)$ (the contaminating signal model); $\hat{Y}(k)$ (the rotation speed of the frequency components of the contaminating model); $\lambda_N(k)$ (non-predictable noise); and $\lambda_E(k)$ (noise added during the cancellation process). As noted above, only the first two of these terms, $\hat{Z}(k)$ and $\hat{Y}(k)$ are involved in the above described cancellation process. In fact, any non-predictable noise ($\lambda_N(k)$) and any noise added ($\lambda_E(k)$) by the cancellation process will still remain in the cleaned signal.

As noted above, updating the contaminating signal model, $\hat{Z}(k)$, is performed as a function of the prior state of the model from the preceding frame. In particular, as illustrated by Equation 9, the contaminating signal model, $\hat{Z}(k)$ is updated as follows:

$$\hat{Z}_k^{(n)} = (1-\alpha)\hat{Z}_k^{(n-1)} + \alpha(p_k^{(n)} X_k^{(n)} + (1-p_k^{(n)})\hat{Z}_k^{(n-1)}) \quad \text{Equation 9}$$

where $$\alpha = \frac{T}{\tau_Z},$$

and $\tau_Z$ is an adaptation time constant that is set just large enough to avoid canceling components of the underlying signal along with cancellation of the contaminating signal. For example, in a tested embodiment using a speech signal, a $\tau_Z$ on the order of about 0.08 seconds was found to provide good cancellation of approximately stationary signal contamination without removing or adversely any of the pitch and its harmonics from the speech signal.

In addition, and $p_k^{(n)}$ in Equation 9 represents the probability that only the contaminating signal $Z_k^{(n)}$ is present in the current frame of $X_k^{(n)}$. In other words, $p_k^{(n)}$ represents a probability of an absence of the wanted signal, s(t). Depending upon the signal type, there are a number of conventional techniques for determining $p_k^{(n)}$. For example, where s(t) represents an audio signal comprising speech (such as a telephone call, for example) a conventional voice activity detector (VAD) is used to produce a per-bin probability estimation of speech presence. Note that the use of this probability is optional, such that if $p_k^{(n)}$ is not used (i.e., $p_k^{(n)} \equiv 1$), Equation 8 will simplify to: $\hat{Z}_k^{(n)} = (1-\alpha)\hat{Z}_k^{(n-1)} + \alpha X_k^{(n)}$. However, in tested embodiments of the Interference Canceller, the use of signal detection techniques, such as a VAD, was found to provide a higher SNR in the cleaned output signal. Further, if $p_k^{(n)}$ is not used, the adaptation time constants, $\tau_Z$ and $\tau_Y$ (introduced below), should be carefully tuned to avoid introducing distortions into the cleaned output signal.

Similarly, the additive noise variance, $\lambda_N(k)$, is updated as illustrated by Equation 10, where:

$$\lambda_N^{(n)} = (1-\alpha)\lambda_N^{(n-1)} + \alpha(p_k^{(n)}\delta_k^{(n)} + (1-p_k^{(n)})\lambda_N^{(n-1)}) \quad \text{Equation 10}$$

where $\delta_k^{(n)}=\|X_k^{(n)}-\hat{Z}_k^{(n-1)}\|^2$. Again, the probability, $p_k^{(n)}$ is optional, and if not used (i.e., $p_k^{(n)}\equiv 1$), Equation 10 will simplify to: $\lambda_N^{(n)}=(1-\alpha)\lambda_N^{(n-1)}+\alpha\delta_k^{(n)}$.

Similarly, the rotating speed estimation, $\hat{Y}(k)$, is updated in the same way, as illustrated by Equation 11, where:

$$\hat{Y}_k^{(n)}=(1-\beta)\hat{Y}_k^{(n-1)}+\beta(p_k^{(n)}Y_{mom}^{(n)}(k)+(1-p_k^{(n)})\hat{Y}_k^{(n-1)}) \quad \text{Equation 11}$$

where $$Y_{mom}^{(n)}(k)=\frac{Y_k}{\|Y_k\|+\varepsilon}$$

is a normalized momentary rotation speed estimation, $$Y_k=\frac{X_k^{(n)}}{X_k^{(n-1)}+\varepsilon}$$

for the current frame, $\epsilon$ is a small number, where $\beta=T/\tau_Y$, $\tau_Y$ is a small adaptation time constant that is set just large enough to avoid canceling components of the underlying signal along with cancellation of the contaminating signal. For example, in a tested embodiment using a speech signal, a $\tau_Y$ on the order of about 0.8 seconds was found to provide good cancellation of approximately stationary signal contamination without removing or adversely any of the pitch and its harmonics from the speech signal. Again, since $p_k^{(n)}$ is optional, if not used (i.e., $p_k^{(n)}\equiv 1$), Equation 11 will simplify to: $\hat{Y}_k^{(n)}=(1-\beta)\hat{Y}_k^{(n-1)}+\beta p_k^{(n)}Y_{mom}^{(n)}(k)$.

The foregoing description of the Interference Canceller has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the Interference Canceller. It is intended that the scope of the invention be limited not by this detailed description, but rather by the claims appended hereto.

What is claimed is:

1. A computer-readable medium having computer executable instructions for canceling approximately stationary noise from an input signal, said computer executable instructions comprising:

receiving an input signal including contamination by one or more noise sources;

processing consecutive partially overlapping frames of the input signal to produce corresponding blocks of frequency domain transform coefficients for each frame of the input signal;

for each block of transform coefficients, updating an estimated complex model of noise contaminating the input signal, said model including any of stationary and approximately stationary noise;

for each block of transform coefficients, estimating a complex plane rotation speed of frequency components comprising each block of transform coefficients;

for each block of transform coefficients, using the estimated complex model of noise in combination with the estimated rotation speed of the frequency components to extrapolate an estimate of the noise to a next sequential block of transform coefficients; and subtracting the extrapolated estimate of the noise from each next sequential block of transform coefficients to generate a frequency domain representation of an output signal.

2. The computer-readable medium of claim 1 wherein the input signal further includes contamination by non-predictable noise, and further comprising performing a frequency-domain noise suppression operation on the frequency domain representation of the output signal to attenuate the non-predictable noise.

3. The computer-readable medium of claim 1 further comprising transforming the frequency domain representation of the output signal to reconstruct a time domain version of the output signal, said time domain version of the output signal representing a version of the input signal from which an estimate of the approximately stationary noise has been cancelled.

4. The computer-readable medium of claim 3 further comprising providing a real-time playback of the output signal.

5. The computer-readable medium of claim 1 wherein the input signal is a real-time speech signal.

6. The computer-readable medium of claim 5 further comprising computing a probability of speech absence for each block of transform coefficients, and wherein the probability of speech absence is used in computing the estimated complex model of noise and the estimated complex plane rotation speeds.

7. The computer-readable medium of claim 5 further comprising encoding the frequency domain representation of the output signal using a transform-domain encoder.

8. A method for canceling noise from a signal, comprising using a computing device to:

receive a frequency-domain representation of a noisy input signal comprising consecutive blocks of transform coefficients corresponding to overlapping frames of the noisy input signal;

estimating a complex plane rotation speed of frequency components comprising each block of transform coefficients;

evaluating each block of transform coefficients to generate an estimated complex noise model for modeling predictable noise, including any of stationary and approximately stationary noise, in the noisy input signal;

for each block of transform coefficients, using the estimated complex noise model in combination with the estimated rotation speeds to extrapolate an estimate of the predictable noise to a next sequential block of transform coefficients; and from each next sequential block of transform coefficients, subtracting the extrapolated estimate of noise to generate a frequency domain representation of an output signal.

9. The method of claim 8 further comprising performing a frequency-domain noise suppression operation on the frequency domain representation of the output signal to attenuate non-predictable noise in the noisy input signal.

10. The method of claim 8 wherein the input signal is a real-time speech signal.

11. The method of claim 10 further comprising transforming the frequency domain representation of the output signal to reconstruct a time domain version of the output signal.

12. The method of claim 11 further comprising providing a real-time playback of the time-domain version of the output signal.

13. The method of claim 10 further comprising computing a probability of speech absence for each block of transform coefficients, and wherein the probability of speech absence is used in computing the estimated complex noise model and the estimated complex plane rotation speeds.

14. A system for providing real-time noise cancellation in a speech signal, comprising using a computing device to perform steps for:

receive overlapping frames of a real-time time domain input of a noisy speech signal;

as each frame of the noisy input signal is received, transform each frame into a corresponding block of transform coefficients;

evaluating each block of transform coefficients to generate an estimated noise model for modeling any of stationary and approximately stationary noise in the noisy input signal;

estimating complex plane rotation speeds of frequency components comprising each block of transform coefficients from each current block of transform coefficients towards corresponding frequency components in each next block of transform coefficients;

for each block of transform coefficients, using the estimated noise model in combination with the estimated rotation speeds to extrapolate an estimate of the stationary and approximately stationary noise to a next sequential block of transform coefficients;

from each next sequential block of transform coefficients, subtracting the extrapolated estimate of noise to generate a frequency domain representation of an output signal; and transforming each block of coefficients of the frequency domain representation of the output signal to the time domain to reconstruct a real-time time domain speech output signal.

15. The system of claim 14 further comprising performing a frequency-domain noise suppression operation on the frequency domain representation of the output signal prior to transforming the signal to the time domain to attenuate non-predictable noise in the noisy speech signal.

16. The system of claim 14 further comprising providing a real-time playback of the time domain speech output signal.

17. The system of claim 14 further comprising encoding each block of transform coefficients of the frequency domain representation of the output signal to compress the frequency domain representation of the output signal for transmission across a network.

18. The system of claim 14 further comprising computing a probability of speech absence for each block of transform coefficients of the noisy input signal, and wherein the probability of speech absence is used in computing the estimated noise model and the estimated complex plane rotation speeds.

19. The system of claim 18 wherein computing a probability of speech absence for each block of transform coefficients comprises processing each block of transform coefficients using a voice activity detector.

20. The system of claim 14 further comprising storing the time domain speech output signal on a computer readable medium.

* * * * *